United States Patent [19]

Lindquist

[11] 4,429,909

[45] Feb. 7, 1984

[54] RESTRAINT ASSEMBLY FOR DOOR EXIT DEVICES

[76] Inventor: John L. Lindquist, 2109 Scarborough Dr., Lodi, Calif. 95240

[21] Appl. No.: 395,172

[22] Filed: Jul. 6, 1982

Related U.S. Application Data

[63] Continuation-in-part of Ser. No. 329,729, Dec. 11, 1981, abandoned.

[51] Int. Cl.[3] ..... E05C 15/02

[52] U.S. Cl. ..... 292/92

[58] Field of Search ..... 292/92, 21, 258, 288

[56] References Cited

U.S. PATENT DOCUMENTS

| | | | |
|---|---|---|---|
| 2,758,861 | 8/1956 | Molloy | 292/57 |
| 3,073,142 | 1/1963 | Stebbins | 292/92 X |
| 3,722,938 | 3/1973 | Bauer et al. | 292/92 |
| 4,331,352 | 5/1982 | Helding et al. | 292/92 |

*Primary Examiner*—Richard E. Moore

*Attorney, Agent, or Firm*—Phillips, Moore, Lempio & Finely

[57] ABSTRACT

A door exit device has a pivotal panic bar that is depressable from a raised position to unlatch a door. A lock assembly for the device comprises a pivotal member movable between an engaged position with the panic bar to hold it in its raised position and a disengaged position to permit pivotal depression of the panic bar and opening of the door. The member is mounted on the door and a locking feature is provided to hold the member in at least one of its engaged and disengaged positions. In two described embodiments of this invention, the member comprises an arm pivotally mounted for vertical movements to engage a cross-bar of the panic bar, in a third embodiment an arm pivots horizontally to engage a lever arm of the panic bar, and in a fourth embodiment the pivotal member comprises an extended end of a torsion spring adapted to engage and hold the panic bar in its raised position.

24 Claims, 15 Drawing Figures

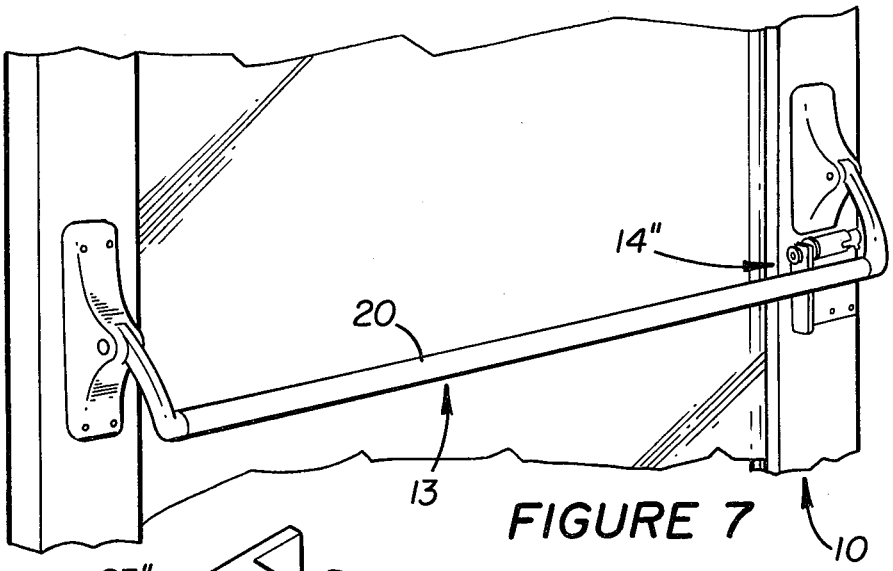
FIGURE 7
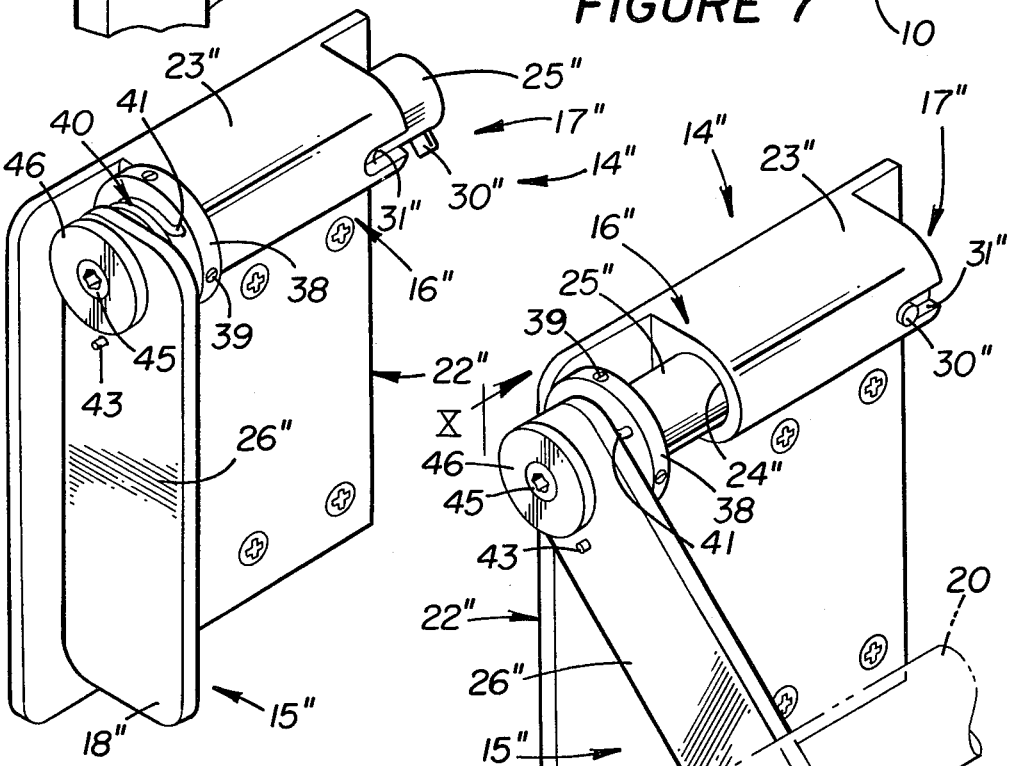
FIGURE 8
FIGURE 9

FIGURE 14
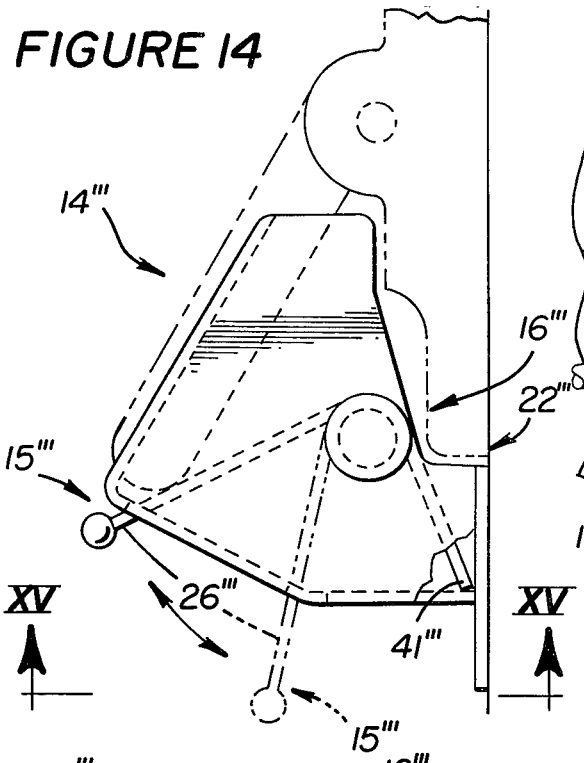
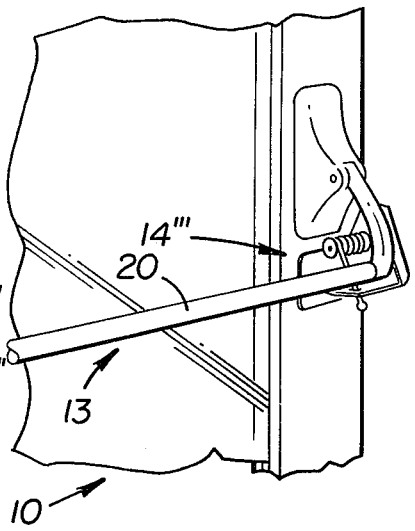
FIGURE 12
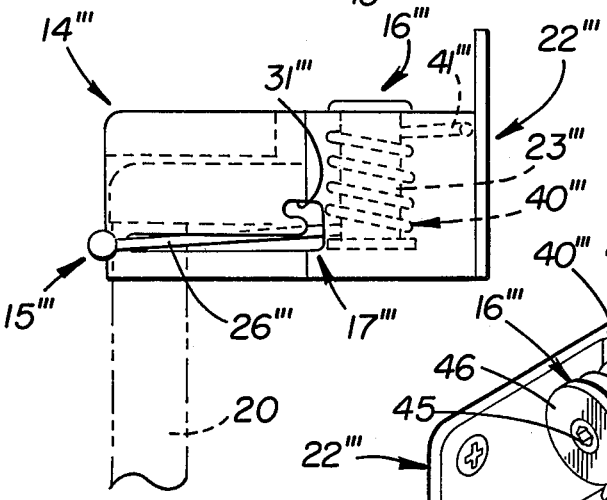
FIGURE 15
FIGURE 13
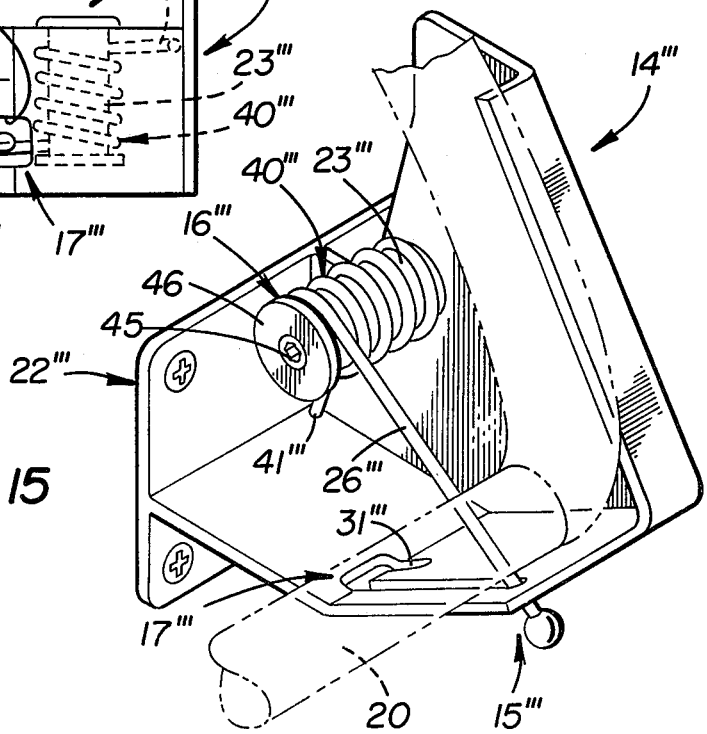

RESTRAINT ASSEMBLY FOR DOOR EXIT DEVICES

CROSS-REFERENCE TO RELATED APPLICATION

This application is a continuation-in-part Of U.S. patent application Ser. No. 329,729, filed on Dec. 11, 1981, and now abandoned.

TECHNICAL FIELD

This invention relates generally to a restraint assembly adapted to hold a latch bolt of a door exit device in its latched position, and more particularly to a restraint assembly having a movable member adapted for engagement with the panic bar of the door exit device to deter depression of the panic bar and opening of the door.

BACKGROUND ART

Door exit devices for use in schools and other public buildings normally include a latch bolt adapted to be retracted from its latched position upon depression of a panic bar. The State of California, for example, has enacted laws requiring this type of "panic hardware" on at least one door to provide egress from a room designed to hold forty or more people. Panic hardware of this type is vulnerable to opening by the insertion of a wire or other appropriate tool between the door and door jamb to either retract the latch bolt or to engage and depress the panic bar to open the door.

DISCLOSURE OF INVENTION

This invention provides an improved restraint assembly for engaging and holding the panic bar of a door exit device in its raised position to deter opening of the door. The restraint assembly comprises a pivotal member movable between an engaged position with the panic bar to hold it in its raised position, and a disengaged position to permit pivotal depression of the panic bar for door opening purposes. A preload means is provided for imposing a predetermined preload on the member to hold it in its engaged position and to permit pivotal depression of the panic bar when a predetermined opening force is imposed thereon in an emergency situation.

BRIEF DESCRIPTION OF THE DRAWINGS

Other objects and advantages of this invention will become apparent from the following description and accompanying drawings wherein:

FIGS. 7–9 are views similar to FIGS. 1–3 , but illustrate a third and preferred restraint assembly embodiment of this invention;

FIG. 11 is an exploded isometric view of the FIGS. 7–9 restraint assembly;

FIG. 12 partially illustrates a door having a fourth and also preferred restraint assembly embodiment mounted thereon; and FIGS. 13–15 are isometric, side elevational, and bottom plan views of the fourth restraint assembly embodiment, respectively.

APPLICANT'S PROTOTYPE RESTRAINT ASSEMBLY

Figure 1:
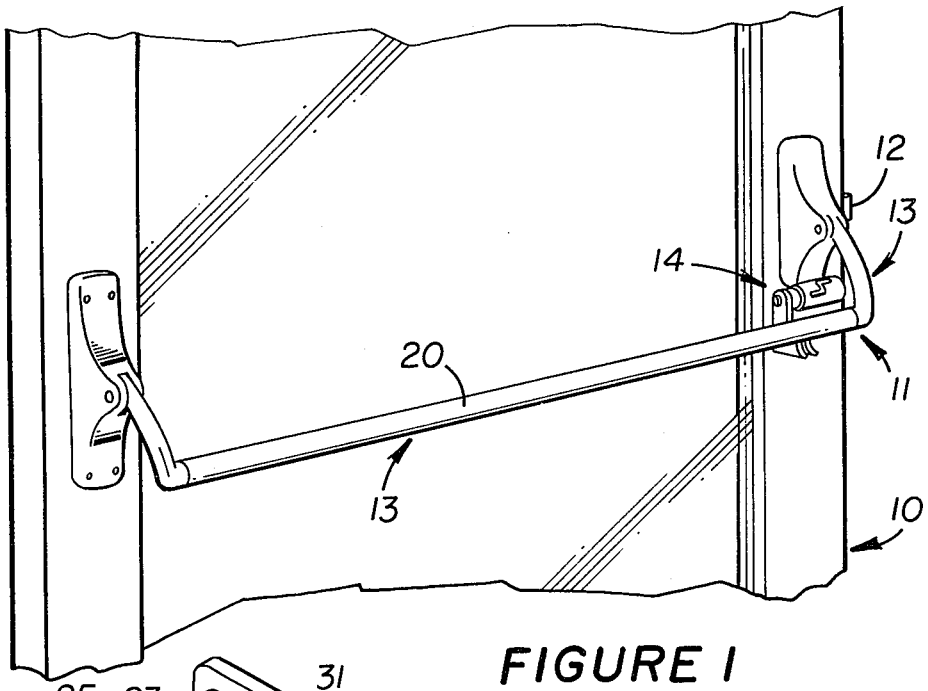
FIG. 1 partially illustrates a door having an exit device mounted thereon, along with a restraint assembly which was a prototype embodiment of this invention.

FIG. 1 illustrates a standard door 10 mounted on hinges (not shown) and adapted to be opened by a standard exit device 11 having a latch bolt 12. This type of panic hardware can be either of the mortice or vertical rod type, such as a commercially available VonDurpin exit device. The illustrated exit device includes a panic bar 13 pivotally mounted on the door and adapted to be depressed to retract latch bolt 12 from its latched position to its unlatched position for door opening purposes.

Figure 2:
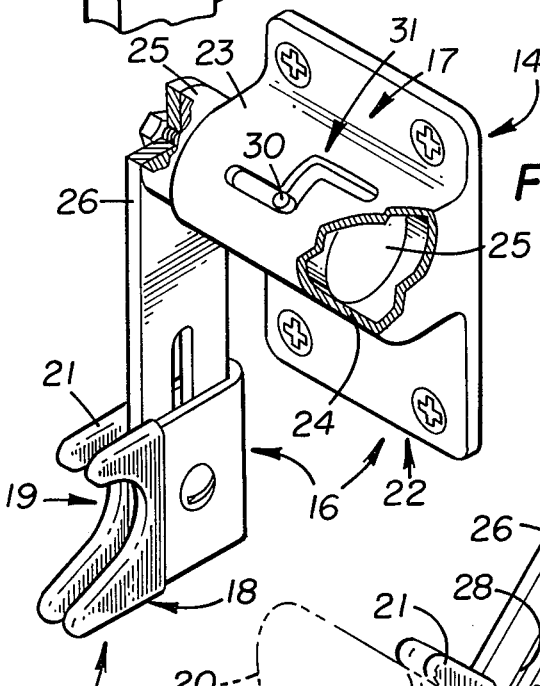
FIGS. 2 and 3 are enlarged isometric views of the restraint assembly, shown in its disengaged and stored position and in its engaged position with a panic bar of the exit device respectively.
Figure 3:
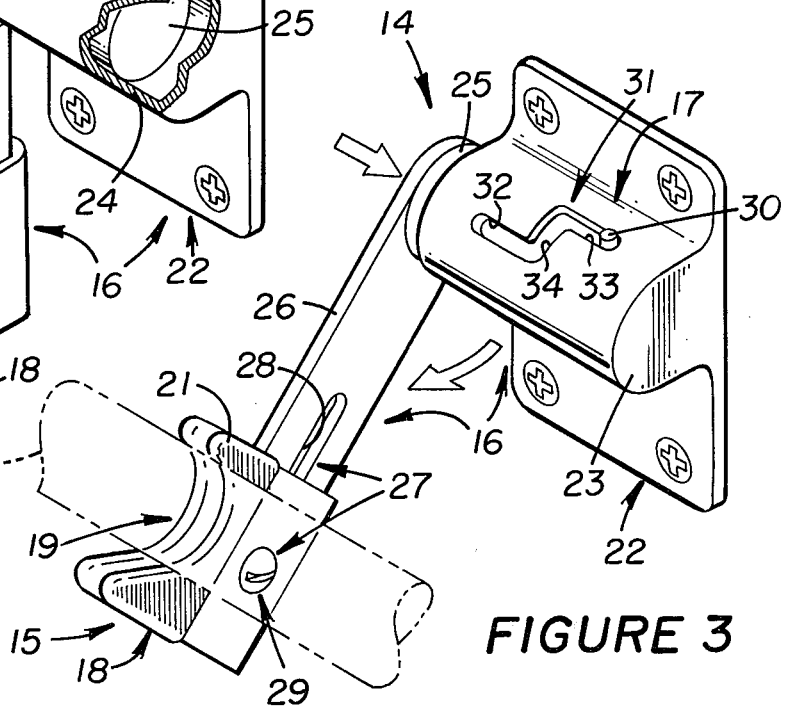

FIGS. 1–3 illustrate a prototype restraint assembly 14 for selectively holding panic bar 13 in its raised position to deter opening of the door. The prototype contains certain features of applicant's invention, as claimed, and was the genesis for creation of the preferred restraint assembly embodiments illustrated in FIGS. 7–15. The restraint assembly includes first means 15 movable between a disengaged position adjacent to the door (FIG. 2) to permit pivotal depression of the panic bar and opening of the door and an engaged position (FIG. 3) with the panic bar to hold it in its raised position. The restraint assembly further comprises second means 16 for mounting the first means on the door for movement between its engaged and disengaged positions and restraint means 17 for selectively holding the first means in each of its engaged and disengaged positions.

First means 15 may include a catch 18, shown in the form of a single U-shaped metallic plate bent over onto itself and defining a U-shaped recess 19 therein. The recess is suitably formed to receive and generally conform to the cylindrical configuration of a cross-bar 20 of the panic bar. If so desired, a thin rubber or plastic coating 21 can be formed on the end of catch 18, as shown, to prevent metal-to-metal contact between the catch and the cross-bar. The coating may be applied to the catch by any suitable process, such as dip molding.

Second or mounting means 16 includes a mounting bracket 22 adapted to be secured to the door by a plurality of screws or the like. The mounting bracket has a tubular housing 23 formed integrally therewith with the housing defining a horizontally disposed cylindrical bore 24 therein (FIG. 2). A cylindrical plunger 25 is slidably and rotatably mounted in the bore and has a member in the form of an arm 26 secured to one end thereof to extend transversely relative to the plunger.

As shown in FIG. 1, the arm comprises a component part of first means 15 and is preferably secured to the plunger by a centrally disposed set screw, tightened under a predetermined torque (e.g., fifteen pounds preload). This arrangement thus provides means for imposing a predetermined preload or holding force on the arm for permitting the panic bar to be depressed and the arm to pivot relative to the plunger (FIG. 3) under a predetermined opening force of high magnitude to open the door in an emergency situation, i.e., depression of the panic bar will overcome lock means 17.

Catch 18 is preferably secured to the opposite end of the arm to form a part thereof by an adjustment means 27. The adjustment means includes a longitudinal slot 28 formed through the arm and a releasable fastening means, such as a screw 29 extending through the catch and slot and having a nut (not shown) threaded onto the opposite end thereof to releasably clamp the catch onto the arm. Adjustment of the catch in this manner will ensure that U-shaped recesses 19 fully seats beneath cross-bar 20 when the catch is in its FIG. 3, raised position. As described more fully hereinafter in respect to the FIGS. 7–11 and FIGS. 12–15 embodiments, members 26, 26″, or 26‴, with or without catch 18, can be considered "first means" for holding the panic bar in its raised position.

In the FIGS. 1–3 embodiment, lock means 17 comprises a pin or lug 30 secured on a second end of plunger 25 to project radially outwardly therefrom. During assembly, the plunger would be first inserted into bore 24 and then the lug would be suitably secured in a conventional manner to the plunger. The lug is adapted to move in a generally S-shaped slot means 31 comprising horizontally-disposed storing and locking slots 32 and 33 that are longitudinally separated and circumferentially spaced from each other by an intermediate and vertically disposed intermediate slot 34. Slots 32 and 33 are disposed in at least approximate parallel relationship relative to the longitudinal axis of plunger 25.

When the restraint assembly is in its disengaged condition of operation, arm 26 can be moved leftwardly in FIG. 2 to dispose lug 30 in storing slot 32, whereby rotation of plunger 25 is prevented to retain arm 26 in a vertical disposition closely adjacent to the frame of the door. When it is desired to place the restraint assembly in its engaged condition of operation, arm 26 is slid rightwardly to its FIG. 2 position, rotated generally clockwise to move lug 30 upwardly in slot 34, and then shifted rightwardly to dispose the lug in locking slot 33. Simultaneously therewith, the U-shaped recess 19 of catch 18 will engage beneath cross-bar 20 and will be held in this position by engaged lock means 17.

Although slots 32 and 33 are shown in parallel relationship relative to the longitudinal axis of plunger 25, it should be understood that other configurations of the slots could be utilized, if so desired. For example, it may prove desirable to either askew locking slot 33 relative to the longitudinal axis of plunger 25 or form a notch in the bottom of the locking slot whereby arm 26 would necessitate a slight clockwise rotation in FIG. 3 before it could be slid leftwardly and then rotated counterclockwise to move lug 30 downwardly in slot 34 to disengage the restraint assembly.

Figure 4:
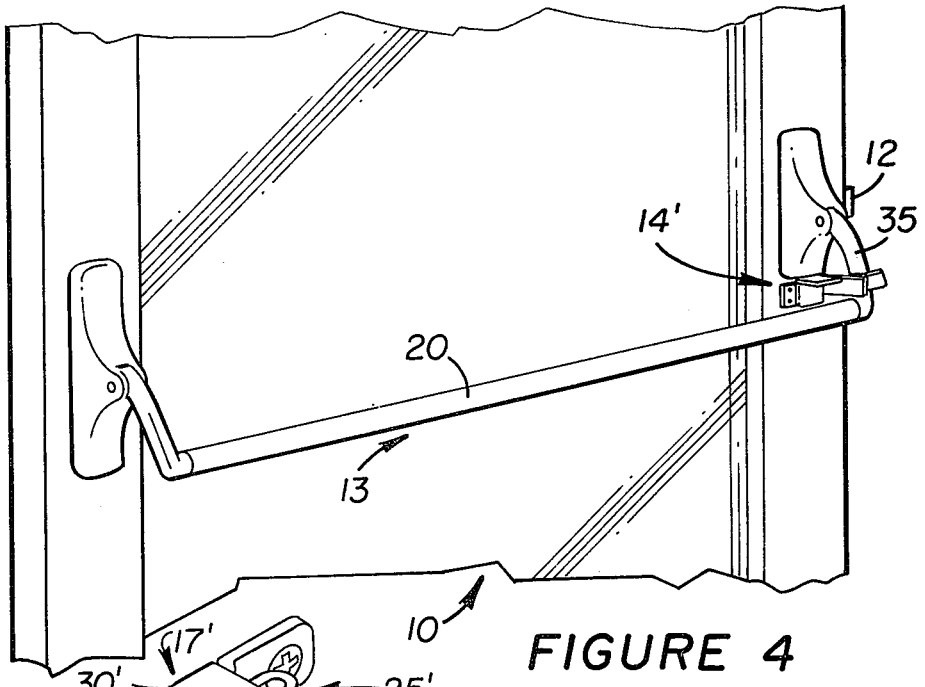
FIGS. 4–6 are views similar to FIGS. 1–3, but illustrate a second restraint assembly embodiment.
Figure 5:
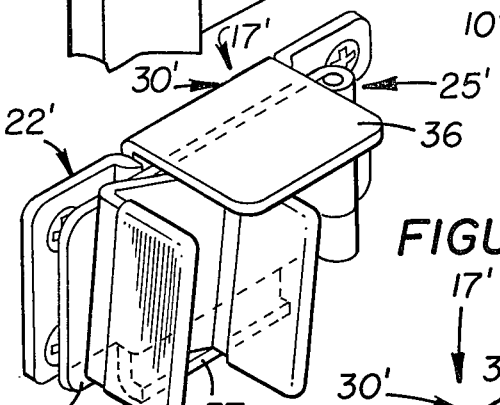
Figure 6:
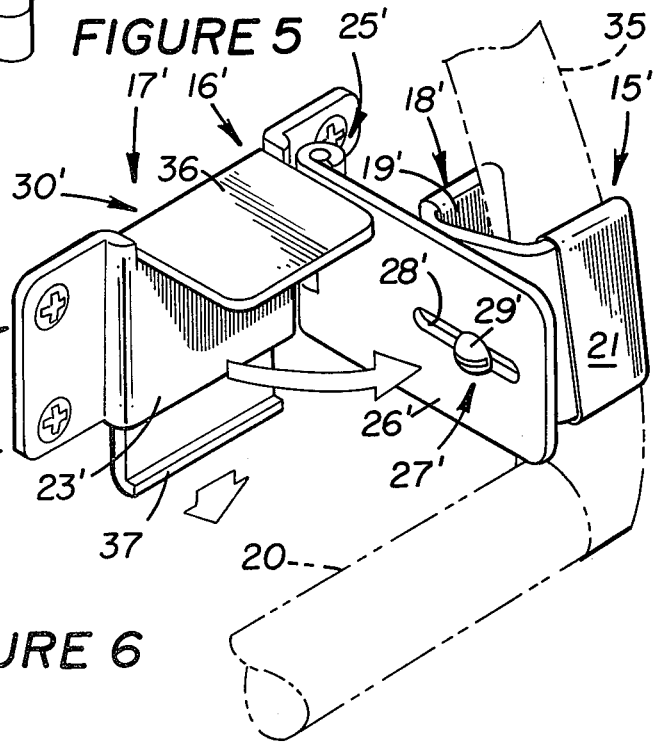

FIGS. 4–6 illustrate a second restraint assembly embodiment 14′ wherein corresponding constructions and arrangements are identified by the same numerals, but with numerals depicting modified constructions in FIGS. 4–6 being accompanied by a prime symbol (′). Restraint assembly 14′ also includes a first means 15′ movable between an engaged position beneath the panic bar to hold it in its raised position, and a disengaged position adjacent to the door to permit pivotal depression of the panic bar. First means 15′ includes a member in the form of an arm 26′ and a channel-type catch 18′ defining a U-shaped recess 19′ therein for engagement with a lever arm 35 of panic bar 13. The catch may be also thinly coated with a plastic or rubber composition 21 to prevent metal-to-metal contact between the lever arm and the catch.

A second or mounting means 16′ includes a mounting bracket 22′ adapted to be secured to the door frame, beneath lever arm 35, by set screws or the like, and a vertically disposed hinge connection 25′ pivotally mounting arm 26′ on one end of the bracket. The arm is thus adapted to be pivoted horizontally between its FIGS. 5 and 6 positions. Catch 18′ is attached to an end of the arm by an adjustment means 27′ that includes an elongated slot 28 formed through the arm and a screw 29′, either attached to the catch by a nut or a threaded bore formed in the backside of the catch (not shown).

Lock means 17′ for selectively locking first means 15′, including arm 26′ and catch 18′, in its engaged position illustrated in FIG. 6, comprises a lock plate 30′ slidably mounted for limited vertical movements in a channel portion 23′ of bracket 22′. The lock plate has a horizontally disposed upper or lock flange 36 adapted to be lowered to engage a back side of arm 26′ when the arm is pivoted outwardly away from the door to its FIG. 6 position engaging catch 18′ on lever arm 35. Removal of the lock plate from bracket 22′ is prevented by a second flange 37 formed on a lower end of the plate. It can thus be seen that a slight raising of the plate in FIG. 6 will permit arm 26′ and catch 18′ to be pivoted to their stored positions illustrated in FIG. 5 with the plate then being lowered to frictionally engage them for retention purposes.

BEST MODE OF CARRYING OUT THE INVENTION

FIGS. 7–11 illustrate a third and preferred restraint assembly embodiment 14″ wherein corresponding constructions and arrangements are identified by the same numerals, but with numerals depicting modified constructions in FIGS. 7–11 being accompanied by a double-prime symbol (″). Restraint assembly 14″ also includes first means 15″ movable between an engaged position beneath the panic bar to hold it in its raised position (FIGS. 9 and 10) and a disengaged position adjacent to the door to permit pivotal depression of the panic bar (FIGS. 7 and 8). First means 15″ includes a member in the form ofan arm 26″ having a catch portion 18″ to selectively engage beneath the panic bar. If so desired, a thin rubber or plastic coating could also be formed on arm 26″ to prevent metal-to-metal contact between the arm and cross-bar 20.

A second or mounting means 16″ for mounting first means 15″ on the door for movement between its engaged and disengaged positions includes a bracket 22″ adapted to be secured to the door by a plurality of screws or the like. The bracket has a tubular housing 23″ suitably secured thereon with the housing defining a horizontally disposed cylindrical bore 24″ therein. A cylindrical plunger 25″ is slidably and rotatably mounted in the bore and has arm 26″ secured to one end thereof to extend transversely relative to the plunger.

Figure 10:
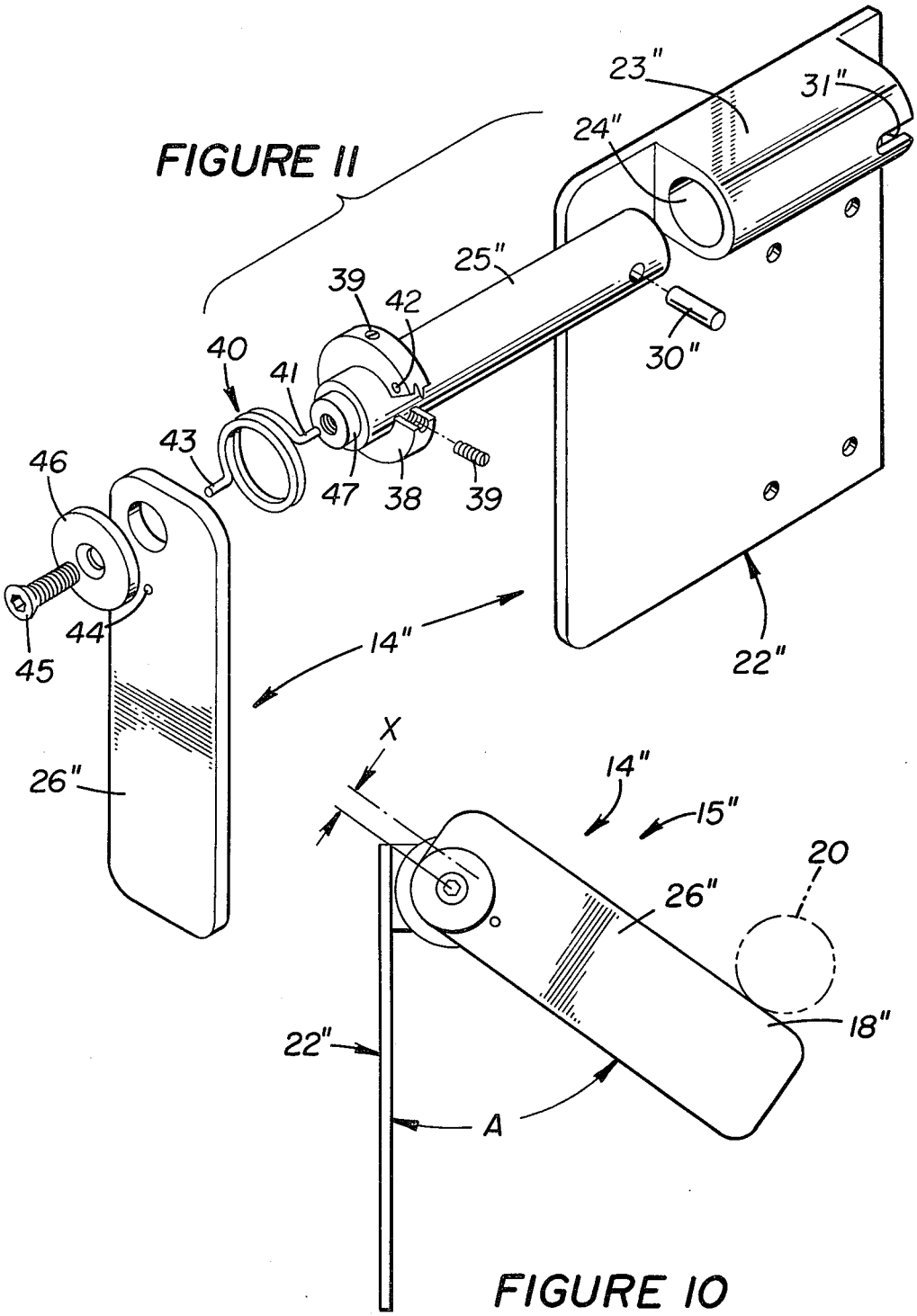
FIG. 10 is an end elevational view of the FIGS. 7–9 restraint assembly, taken in the direction of arrows X—X in FIG. 9.

A lock means 17″ for selectively and releasably locking arm 26″ of first means 15″ in its FIGS. 9 and 10 engaged position beneath the cross-bar comprises a pin or lug 30″ secured on a second end of plunger 25″ to project radially outwardly therefrom. During assembly, the plunger would be first inserted into bore 24″ and then the lug would be suitably secured in a conventional manner to the plunger. The lug is adapted to be moved axially from its FIG. 9 locked position within a horizontally disposed slot means 31″, formed in a wall of housing 23″, to its released position illustrated in FIG. 8 whereby arm 26″ is permitted to fall under the influence of gravity to its vertically disposed stored position against the door.

Referring to the exploded view of restraint assembly 14″ shown in FIG. 11, a collar 38 is releasably secured on an end of plunger 25'' by a plurality of set screws 39. The coils of a torsion spring 40 of the straight offset type are mounted on an end of plunger 25'' and comprise means for imposing a predetermined preload or holding force on arm 26''. A first end 41 of the spring is mounted in a hole 42 formed in the collar and a second end 43 is mounted in a hole 44 formed in arm 26'' (FIGS. 8 and 11). The arm is secured on an end of plunger 25'' by a screw 45 and a washer 46, with the arm being mounted for relative rotation on a reduced diameter portion 47 of the plunger.

Torsion spring 40 may be designed to exhibit a predetermined preload (e.g., 15 pounds) between plunger 25'' and arm 26'' when the spring is "wound" to its FIG. 9, operative condition to permit the panic bar to be depressed and the arm to pivot relative to the plunger to open a latched door in an emergency situation, i.e., depression of the panic bar under a predetermined opening force will overcome the preload on torsion spring 40 to permit such opening of the door.

FIGS. 12–15 illustrate a fourth and also preferred restraint assembly embodiment 14''' wherein corresponding constructions and arrangements are identified by the same numerals, but with numerals depicting modified constructions in FIGS. 12–15 being accompanied by a triple-prime symbol (''').  Restraint assembly 14''' also includes first means 15''' movable between an engaged position beneath the panic bar and a disengaged position adjacent to the door to permit pivotal depression of the panic bar. The first means includes a member in the form of an extended end 26''' of a coil spring 40'''.

A second or mounting means 16''' for mounting the first means on the door includes an open-sided bracket 22''' secured to the door. The bracket has a tubular post 23''' secured on an end wall thereof which mounts the coils of the spring thereon. The end wall further functions to deter the passing of a tool thereby for door opening purposes. The spring is retained on the post by a set screw 45 and washer 46.

A second, shorter end 41''' of the spring engages a back wall of the housing to urge end 26''' into engagement with the panic bar. The spring thus comprises means for imposing a predetermined preload or holding force (e.g., fifteen pounds) on member or end 26''' to permit pivotal depression of the panic bar when a predetermined opening force is imposed thereon in an emergency situation.

A lock means 17''' selectively and releasably locks member 26''' of first means 15''' in its disengaged position (in contrast to lock means 17 that locks member 26 in each of its engaged and disengaged position and lock means 17' and 17'' that each lock member 16' and 26'' in their engaged positions). The lock means comprises an elongated slot formed in a front wall of bracket 22''' and terminating in an offset locking slot 31'''. Thus, as illustrated in FIG. 14, when member 26''' is released from the locking slot it will engage beneath the panic bar to maintain it in its raised position under a predetermined preload.

What is claimed is:

1. A restraint assembly for a door exit device having a pivotal panic bar depressable from a raised position to unlatch a door, said restraint assembly comprising a pivotal member movable between an engaged position beneath said panic bar to hold it in its raised position, and a disengaged position to permit pivotal depression of said panic bar, mounting means for mounting said member on said door for pivotal movement between its engaged and disengaged positions, and preload means for imposing a predetermined preload on said member to hold it in its engaged position beneath said panic bar and to permit pivotal depression of said panic bar and said member when a predetermined opening force is imposed on said panic bar.

2. The restraint assembly of claim 1 further comprising lock means for selectively and releasably locking said member in its engaged position.

3. The restraint assembly of claim 1 wherein said preload means for imposing a predetermined preload on said member includes a torsion spring.

4. The restraint assembly of claim 3 wherein said member comprises an extended first end of said torsion spring.

5. The restraint assembly of claim 4 wherein said mounting means comprises a bracket having said torsion spring mounted thereon and wherein a second end of said torsion spring engages said bracket to urge the first end thereof into its engaged position.

6. The restraint assembly of claim 5 further comprising slot means formed in said bracket for holding the first end of said torsion spring in its disengaged position.

7. The restraint assembly of claim 3 wherein said mounting means comprises a bracket adapted for securance to said door, an elongated and horizontally disposed bore defined in said bracket, and a plunger pivotally and reciprocally mounted in said bore and secured to said member, said torsion spring interconnected between said member and said plunger.

8. The restraint assembly of claim 7 further comprising a pin secured on said plunger to extend radially outwardly therefrom and slot means formed in said bracket for receiving said pin therein when said member is in its engaged position.

9. The restraint assembly of claim 8 wherein said slot means comprises an open slot formed longitudinally at an end of said bracket to permit said pin to be received therein to maintain said member in its engaged position and to permit said pin to move out of said slot upon reciprocation of said plunger to permit said member to be moved to its disengaged position.

10. The restraint assembly of claim 1 further comprising a door having said exit device and said restraint assembly mounted thereon, said exit device including a horizontally disposed cross-bar and a pair of lever arms pivotally mounting said cross-bar on said door.

11. The restraint assembly of claim 10 wherein said mounting means pivotally mounts said member on said door for vertical movement between its engaged and disengaged positions relative to said cross bar.

12. A door having an exit device and a restraint assembly each mounted thereon, said exit device comprising a pivotal panic bar depressable from a raised position to unlatch said door, said restraint assembly comprising a member movable between an engaged position beneath said panic bar to hold it in its raised position, and a disengaged position to permit pivotal depression of said panic bar, mounting means for mounting said member on said door for movement between its engaged and disengaged positions, and preload means for imposing a predetermined preload on said member to hold it in its engaged position beneath said panic bar and to permit pivotal depression of said panic bar and said member when a predetermined opening force is imposed thereon.

13. The door of claim 12 wherein said preload means comprises spring means for imposing said predetermined preload on said member and beneath said panic bar.

14. The door of claim 13 wherein said spring means comprises a torsion spring.

15. The door of claim 14 wherein said mounting means comprises a plunger pivotally mounted on said door and having said member mounted for relative pivotal movement thereon and wherein said torsion spring is interconnected between said member and said plunger.

16. The door of claim 15 wherein said mounting means further comprises a bracket secured on said door, an elongated and horizontally disposed bore defined in said bracket, and wherein said plunger is pivotally mounted in said bore.

17. The door of claim 16 further comprising a pin secured on said plunger to extend radially outwardly therefrom and slot means formed in said bracket for receiving said pin therein when said member is in its engaged position.

18. The door of claim 17 wherein said plunger is reciprocally mounted in said bore, and said slot means comprises an open slot formed longitudinally at an end of said bracket to permit said pin to be received therein to maintain said member in its engaged position and to permit said pin to move out of said slot upon reciprocation of said plunger to permit said member to be moved to its disengaged position.

19. The door of claim 14 wherein said member comprises an extended first end of said torsion spring.

20. The door of claim 19 wherein said mounting means comprises a bracket having said torsion spring mounted thereon and wherein a second end of said spring engages said bracket to urge the first end thereof into its engaged position.

21. The door of claim 20 further comprising slot means formed in said bracket for holding the first end of said torsion spring in its disengaged position.

22. A restraint assembly for a door exit device having a pivotal panic bar depressable from a raised position to unlatch a door, said restraint assembly comprising a bracket adapted for securance to said door, a plunger pivotally mounted on said bracket, a member attached to said plunger to extend radially outwardly therefrom and pivotal therewith for movement between an engaged position beneath said panic bar to hold it in its raised position, and a disengaged position to permit pivotal depression of said panic bar, lock means for selectively and releasably holding said plunger in a fixed position on said bracket to normally maintain said member in its engaged position beneath said panic bar, and preload means for imposing a predetermined preload on said member to hold it in its engaged position beneath said panic bar and to permit pivotal depression of said panic bar and relative pivoting between said member and said plunger when a predetermined force is imposed on said panic bar.

23. The restraint assembly of claim 22 wherein said preload means comprises fastening means for attaching said member to said plunger under said predetermined preload.

24. The restraint assembly of claim 22 wherein said preload means comprises a torsion spring interconnected between said member and said plunger.

* * * * *